US006397726B1

(12) United States Patent
Litzel

(10) Patent No.: US 6,397,726 B1
(45) Date of Patent: Jun. 4, 2002

(54) DEVICE FOR PATH-DEPENDENT CONTROL OF FORCE GENERATED BY A PISTON

(75) Inventor: Rolf-Günter Litzel, Bad Wiessee (DE)

(73) Assignee: Loctite Deutschland GmbH, Munich (DE)

( * ) Notice: Subject to any disclaimer, the term of this patent is extended or adjusted under 35 U.S.C. 154(b) by 0 days.

(21) Appl. No.: 09/673,656

(22) PCT Filed: May 6, 1999

(86) PCT No.: PCT/EP99/03111

§ 371 (c)(1),
(2), (4) Date: Nov. 6, 2000

(87) PCT Pub. No.: WO99/57443

PCT Pub. Date: Nov. 11, 1999

(30) Foreign Application Priority Data

May 6, 1998 (DE) ..... 298 08 049 U

(51) Int. Cl.[7] ..... F15B 11/00
(52) U.S. Cl. ..... 91/533; 91/447
(58) Field of Search ..... 91/519, 533, 444, 91/447; 60/425

(56) References Cited

U.S. PATENT DOCUMENTS 4,255,930 A 3/1981 Natalie ..... 60/546

FOREIGN PATENT DOCUMENTS

| | | | |
|---|---|---|---|
| DE | 1576181 | 6/1969 | |
| DE | 4441098 | 5/1996 | ..... F15B/3/00 |
| EP | 0592950 | 4/1994 | ..... B61F/5/10 |

*Primary Examiner*—Edward K. Look
*Assistant Examiner*—Michael Leslie
(74) *Attorney, Agent, or Firm*—Steven C. Bauman

(57) ABSTRACT

The invention provides a method and apparatus for controlling in a path-dependent manner the force generated by a piston. A first piston travels in a first cylinder—divided into a first and second chamber by the first piston—together with a pressure fluid. A second cylinder is provided in which a second piston travels. Like the first cylinder, the second cylinder is also divided by the second piston into a first and a second chamber, in this case by the second piston. The first and second pistons are coupled mechanically. The pressure in the second chamber of the second cylinder is regulated such that it is always equal to the counterpressure in the first chamber of the second cylinder and the second chamber of the first cylinder.

12 Claims, 1 Drawing Sheet

DEVICE FOR PATH-DEPENDENT CONTROL OF FORCE GENERATED BY A PISTON

Figure 1:
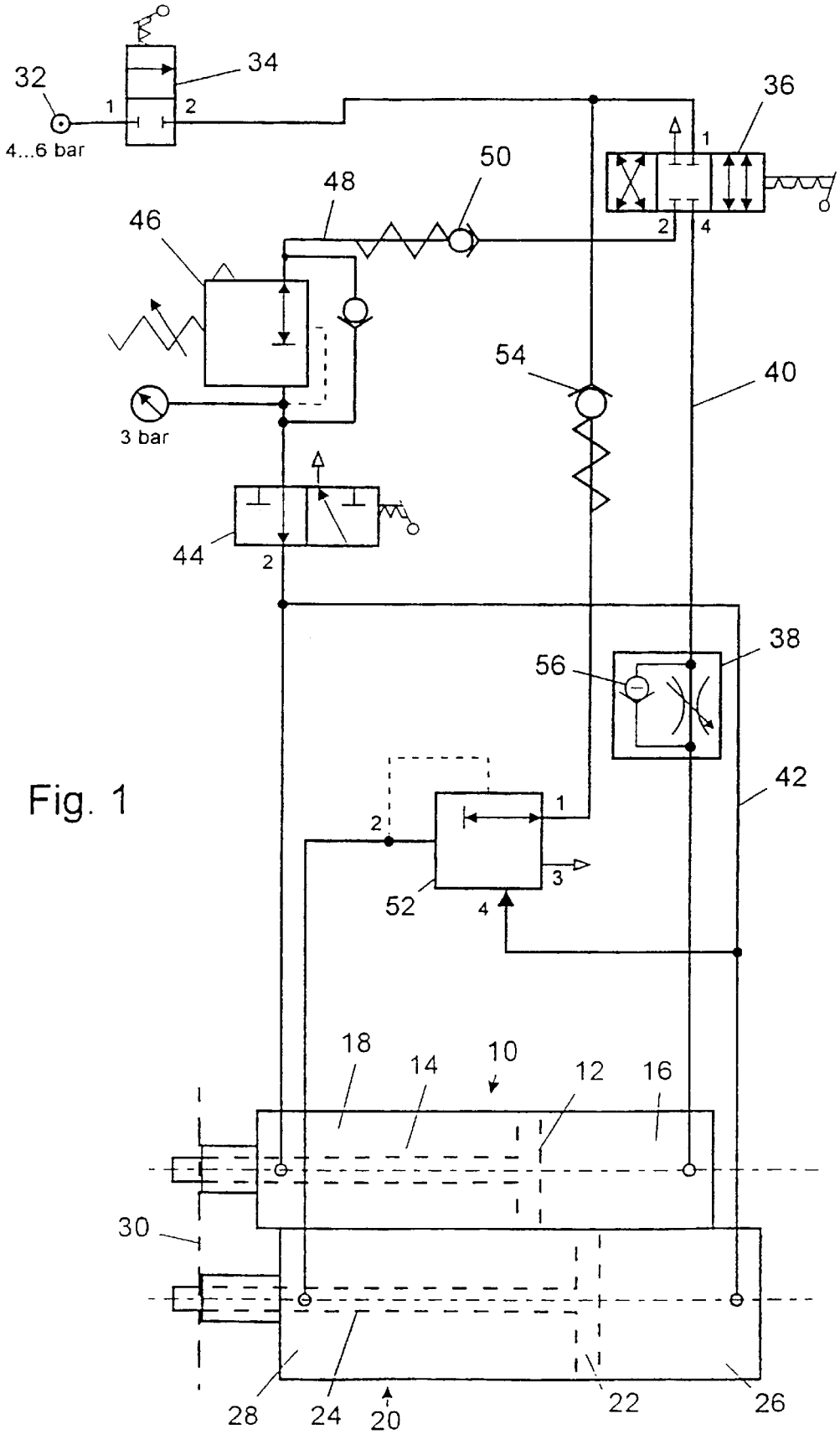

The invention relates to a method and a device for the path-dependent control of the force generated by a first piston, which piston travels in a first cylinder which is divided by the first piston into a first and a second chamber, a pressure fluid being introduced into the first chamber. A second cylinder is also provided for in which a second piston travels and is likewise divided by the second piston into a first and a second chamber.

A similarly designed system is known from DE-A-44 41 098 and functions as an actuation device boosted by external force. The fluid pressure is generated by a master cylinder and transmitted to the first chamber of a slave cylinder and the first chamber of the cylinder of a transmission unit. The system works hydraulically and the slave cylinder and the master cylinder of the transmission unit are stepped, the second chambers each having the greater diameter. As long as the external force exists, the transmission unit is held at rest position because the pressure generated by the master cylinder is not sufficient for moving the piston of the transmission unit against the pressure of the external force supply acting in the second chamber. When the external force supply is lacking, that counter force is absent and the piston is moved, whereby the second chamber is reduced. The pressure built up at the feed point of the external force is transmitted to the second chamber of the slave cylinder and thereby boosts it.

The objective of the invention is to control the force generated by a piston in the simplest possible manner with dependence on the path of travel of the piston.

This objective is achieved according to the invention by the two pistons being coupled so that the second piston is pulled along by the first piston, and by the second chamber of the first cylinder being connected to the first chamber of the second cylinder so that the same pressure prevails in both chambers.

When the first piston performs an extension movement, the fluid is conducted out of the second chamber of the first cylinder into the first chamber of the second cylinder. As the two pistons are coupled, they move synchronously so that in the event of an extension movement, the reduction of the second chamber of the first cylinder is accompanied by an enlargement of the first chamber of the second cylinder. If the diameter of the second cylinder is made greater than that of the first cylinder, the overall volume of the second chamber of the first cylinder and the first chamber of the second cylinder increases when the first piston performs an extension movement, so that the counterpressure falls and the force generated by the first cylinder increases continuously in a path-dependent manner when the first piston extends.

If, however, the second cylinder has a smaller diameter, the force generated by the first cylinder falls continuously when there is an extension movement.

In each case, the force generated by the first piston is a largely steady and linear function of its extension path.

The pressure in the second chamber of the second cylinder is preferably regulated so that it is always equal to the counterpressure, that is, the pressure in the first chamber of the second cylinder and in the second chamber of the first cylinder.

The two cylinder-piston units can be standard cylinders including a piston and the two chambers of each cylinder can have the same diameter. The coupling of the two pistons is appropriately mechanical and positive.

The initial value of the counterpressure of the first cylinder is preferably adjustable, to which end its second chamber can be connected to the source for pressure fluid, via a regulator at which the initial counterpressure value can be set.

The pressure fluid is preferably a compressed gas, especially compressed air. The source of the pressure fluid the pressure gas or the pressurized air is the sole power source of the system.

The invention can be used, for example, for a device for dispensing viscous compositions contained in aluminium cartridges having a corrugated surface. The viscous composition may, for example, be an adhesive. The cartridge is compressed for dispensing the compositions. The force required to do this increases according to the degree to which the cartridge is already compressed. Therefore, to dispense the viscous composition at a constant rate and volume, it is necessary to control the force exerted on the cartridge, and that being to have it increased, with dependence on the remaining size of the cartridge. To do this, the cartridge can be inserted into a dispensing device in which it can be acted upon by the first piston of the device according to the invention.

An embodiment of the invention is explained below with reference to the drawing, FIG. 1 showing a schematic diagram of the pressure control.

In the embodiment shown, a first or dispensing cylinder 10 and a second or control cylinder 20 are arranged side by side in parallel. In dispensing cylinder 10, a first or dispensing piston 12 travels with a piston rod 14, and divides dispensing cylinder 10 into a first chamber 16 and a second chamber 18, the second chamber 18 being at the piston rod 14 side.

In a corresponding manner, a second or control piston 22 travels in control cylinder 20 with a piston rod 24, and divides control cylinder 20 into a first chamber 26 and a second chamber 28, the second chamber 28 being at the piston rod 24 side.

The two piston rods 14, 24 are coupled mechanically and positively outside cylinders 10, 20 by an intimated connection 30 so that they can move only synchronously.

Compressed air serves as pressure fluid and is conducted into the first chamber 16 of dispensing cylinder 10 from a compressed air source 32 via a stop valve 34, a hand-operated slide valve 36 with three positions and choke 38 by means of a line 40. The speed of extension movement of dispensing piston 12 can be set using choke 38. A parallel non-return valve 56 serves for the rapid venting of the first chamber 16 of dispensing cylinder 10. Stop valve 24 and slide valve 36 are shown in FIG. 1 in their locked position. To pass the pressure fluid through, the two valves are shifted so that there is a connection between the terminals 1 and 2 and respectively 1 and 4. The second chamber 18 of dispensing cylinder 10 is connected to the first chamber 26 of control cylinder 20 via a second line 42. The initial value of the counterpressure prevailing in these two chambers 18, 26 and the second line 42 can be set via a second stop valve 44 and a counterpressure regulator 46 which is connected by means of a line 48 to terminal 2 of slide valve 36 and which can be connected to the compressed air source 32 through an appropriate setting of the slide valve 36. In the third line 48, a non-return valve 50 connected between the counterpressure regulator 46 and connection 2 allows compressed air through only from the compressed air source 32 to the counterpressure regulator 46.

By means of a linear regulator 52 whose terminal 2 is connected to the second chamber 28 of the control cylinder 20, whose control signal terminal 4 is connected to the second line 42 and whose terminal 1 is connected to the compressed air source 32 via a non-return valve 54 and the stop valve 34, and whose terminal 3 is free, the pressure in the second chamber 28 of control cylinder 20 is regulated so that it is equal to the pressure in the first chamber 26 of the control cylinder 20 and thus equal to the counterpressure in dispensing cylinder 10.

For operation, the first stop valve 34 is brought into its through passage position. Slide valve 36 is set so that a connection between terminals 1 and 2 exists so that the counterpressure can build up to, for example, 2 bar via the counter pressure regulator 46 and the second stop valve 44 that is in its through passage position for this purpose. In this position, the first chamber 16 of the dispensing cylinder 10 is vented via a non-return valve 56 lying parallel to choke 38 and the connection between terminals 4 and 3 of the slide valve 36. This causes the two pistons 12 and 22 to return to their initial position in which the volumes of first chambers 16, 26 are at their minimum and those of the second chambers 18, 28 at their maximum. For the extension movement of dispensing piston 12, slide valve 36 is brought into the position in which terminals 1 and 4 are connected so that compressed air of, for example, 4 bar, is conducted into the first chamber 16 of dispensing cylinder 10. Dispensing piston 12 extends as a result (to the left in FIG. 1), and pulls along control piston 22 as a result of the coupling 30. This causes the volume of the second chamber 18 of dispensing cylinder 10 to be reduced. Simultaneously, the volume of the first chamber 26 of control cylinder 20 is thereby increased. As the diameter of control cylinder 20 is larger than that of dispensing cylinder 10, the overall volume of these two chambers 18, 26 that are connected via the second line 42 increases so that the counterpressure falls. As the extension movement of dispensing piston 12 progresses, the force it generates thereby increases, corresponding to a resulting increase in pressure from 2 to 4 bar in the case of the example.

As linear regulator 52 maintains equal pressure in both chambers 26, 28 of the control cylinder, this cylinder generates almost no force. As the second chamber 28 is located on the piston rod 24 side, the surface to which pressure is applied on this side of control piston 22 is slightly smaller so that control piston 22 generates a small amount of force pointing in the direction of extension movement. However, this force serves merely to overcome the friction in the two cylinders 10, 20 as the piston rods extend.

To vent the device, the first stop valve 34 is brought into its locked position, slide valve 36 into the position in which terminals 1 and 2 and respectively 3 and 4 are connected so that the first line 40 is vented. The second line 42 is thereby connected with the air supply, piston rods 14 and 24 are pulled in, and chambers 18, 26 and 28 are filled with the regulated initial value of the counterpressure of, for example, 2 bar. If, in case of need, the second stop valve 44 is brought into its venting position, the second line 42 is vented.

What is claimed is:

1. A method for the path-dependent control of the force generated by a first piston, comprising the steps of:

providing the first piston for travelling in a first cylinder that is divided into a first and second chamber by the first piston, providing a pressure fluid being conducted into the first chamber, providing a second cylinder in which a second piston travels and that is also divided by the second piston into a first and a second chamber, coupling the two pistons so that the second piston is pulled along by the first piston, and connecting the second chamber of the first cylinder to the first chamber of the second cylinder so that the same pressure prevails in both chambers, wherein the pressure in the second chamber of the second cylinder is regulated such that it is always equal to the counterpressure in the first chamber of the second cylinder and the second chamber of the first cylinder.

2. The method according to claim 1, wherein the initial value of the counterpressure in the second chamber of the first cylinder is adjustable.

3. The method according to claim 2, wherein the diameter of the second cylinder is greater than that of the first cylinder so that the counterpressure sinks when the first piston performs an extension movement and in that the force generated by the piston thereby increases path-dependent linearly.

4. The method according claim 1, wherein the diameter of the second cylinder is greater than that of the first cylinder so that the counterpressure sinks when the first piston performs an extension movement and in that the force generated by the piston thereby increases path-dependent linearly.

5. The method according to claim 1, wherein the initial value of the counterpressure in the second chamber of the first cylinder is adjustable.

6. Apparatus for the path-dependent control of the force generated by a first piston comprising a source for a pressure fluid, a first cylinder in which a first piston is travelling and which is divided into a first and second chamber by the first piston, the pressure fluid being conducted into the first chamber, and a second cylinder in which a second piston is travelling and which is also divided by the second piston into a first and second chamber and a line that connects the second chamber of the first cylinder to the first chamber of the second cylinder, wherein a linear regulator regulates the pressure in the second chamber of the second cylinder such that it is always equal to the counterpressure in the first chamber of the second cylinder and the second chamber of the first cylinder. which is defined thereby.

7. Apparatus according to claim 6, wherein the initial value of the counterpressure in the second chamber of the first cylinder is adjustable.

8. The apparatus according to claim 7, wherein the diameter of the second cylinder is greater than that of the first cylinder so that the counterpressure sinks when the first piston performs an extension movement and in that the force generated by the piston thereby increases path-dependent linearly.

9. Apparatus for the path-dependent control of the force generated by a first piston, comprising a source for a pressure fluid, a first cylinder in which a first piston is travelling and which is divided into a first and second chamber by the first piston, the pressure fluid being conducted into the first chamber, a second cylinder in which a second piston is travelling and which is also divided by the second piston into a first and second chamber and a line that connects the second chamber of the first cylinder to the first chamber of the second cylinder, and a linear regulator for regulating the pressure in the second chamber of the second cylinder such that it is always equal to the counterpressure in the first chamber of the second cylinder and the second chamber of the first cylinder wherein the diameter of the second cylinder is greater than that of the first cylinder so that the counterpressure sinks when the first piston performs an extension movement and in that the force generated by the piston thereby increases path-dependent linearly.

10. Apparatus for the path dependent control of the force generated by a first piston, comprising a source for a pressure fluid, a first cylinder in which a first piston is travelling and which is divided into a first and second chamber by the first piston, the pressure fluid being conducted into the first chamber, and a second cylinder in which a second piston is travelling and which is also divided by the second piston into a first and second chamber and a line that connects the second chamber of the first cylinder to the first chamber of the second cylinder wherein the two pistons are coupled so that the second piston is pulled along by the first piston and the second chamber connects the first cylinder to the first chamber of the second cylinder, and wherein the initial value of the counterpressure in the second chamber of the first cylinder is adjustable.

11. Apparatus for the path-dependent control of the force generated by a first piston, comprising a source for a pressure fluid, a first cylinder in which a first piston is travelling and which is divided into a first and second chamber by the first piston, the pressure fluid being conducted into the first chamber, and a second cylinder in which a second piston is travelling and which is also divided by the second piston into a first and second chamber and a line that connects the second chamber of the first cylinder to the first chamber of the second cylinder wherein the two pistons are coupled so that the second piston is pulled along by the first piston and the second chamber connects the first cylinder to the first chamber of the second cylinder, and wherein the diameter of the second cylinder is greater than that of the first cylinder so that the counterpressure sinks when the first piston performs an extension movement and in that the force generated by the piston thereby increases path-dependent linearly.

12. Apparatus for the path-dependent control of the force generated by a first piston, comprising a source for a pressure fluid, a first cylinder in which a first piston is travelling and which is divided into a first and second chamber by the first piston, the pressure fluid being conducted into the first chamber, and a second cylinder in which a second piston is travelling and which is also divided by the second piston into a first and second chamber and a line that connects the second chamber of the first cylinder to the first chamber of the second cylinder, wherein a linear regulator regulates the pressure in the second chamber of the second cylinder such that it is always equal to the counterpressure in the first chamber of the second cylinder and the second chamber of the first cylinder, and wherein the diameter of the second cylinder is greater than that of the first cylinder so that the counterpressure sinks when the first piston performs an extension movement and in that the force generated by the piston thereby increases path-dependent linearly.

* * * * *